US010615530B2

(12) United States Patent
Frank et al.

(10) Patent No.: US 10,615,530 B2
(45) Date of Patent: Apr. 7, 2020

(54) SPRING LOADED ELECTRICAL CONNECTOR

(71) Applicant: Amphenol Corporation, Wallingford, CT (US)

(72) Inventors: Ronald I. Frank, Sharon, MA (US); James R. Meszaros, Middleboro, MA (US); George L. Goulart, Jr., Dighton, MA (US); Braden J. Ishaug, Quincy, MA (US); Robert G. Hennemuth, III, Franklin, MA (US); Michael D. Smith, North Easton, MA (US); Michael A. Yashin, Cranston, RI (US); Gordon J. Udall, North Attleboro, MA (US); Daniel R. Mcnevin, Norton, MA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 16/262,085

(22) Filed: Jan. 30, 2019

(65) Prior Publication Data

US 2019/0173218 A1 Jun. 6, 2019

Related U.S. Application Data

(63) Continuation-in-part of application No. 16/054,746, filed on Aug. 3, 2018, now Pat. No. 10,249,973, which is a continuation of application No. 15/615,470, filed on Jun. 6, 2017, now Pat. No. 10,050,367.

(51) Int. Cl.

| | |
|---|---|
| ***H01R 13/15*** | (2006.01) |
| ***H01R 13/24*** | (2006.01) |
| ***H01R 24/86*** | (2011.01) |
| *H01R 13/193* | (2006.01) |
| *H01R 107/00* | (2006.01) |

(52) U.S. Cl.

CPC ..... *H01R 13/2435* (2013.01); *H01R 24/86* (2013.01); *H01R 13/193* (2013.01); *H01R 2107/00* (2013.01)

(58) Field of Classification Search

CPC ..... H01R 12/82; H01R 12/84
USPC ..... 131/328–329; 439/259
See application file for complete search history.

(56) References Cited

U.S. PATENT DOCUMENTS

| | | | | |
|---|---|---|---|---|
| 3,693,133 | A | 9/1972 | Harbonn | |
| 4,065,197 | A * | 12/1977 | Kuist | H01H 13/785 439/66 |
| 5,230,632 | A | 7/1993 | Baumberger et al. | |
| 5,310,352 | A | 5/1994 | Mroczkowski | |
| 5,857,866 | A | 1/1999 | Felps | |
| 6,165,009 | A * | 12/2000 | Anbo | H01R 12/81 439/498 |
| 6,248,261 | B1 | 6/2001 | Takemura et al. | |
| 6,315,576 | B1 | 11/2001 | Neidich | |
| 6,719,578 | B1 | 4/2004 | Klassen | |
| 6,908,233 | B2 | 6/2005 | Nakajima et al. | |
| 7,128,592 | B2 | 10/2006 | Li | |
| 7,517,222 | B2 | 4/2009 | Rohrbach et al. | |

(Continued)

*Primary Examiner* — Phuong K Dinh
(74) *Attorney, Agent, or Firm* — Blank Rome LLP

(57) ABSTRACT

An electrical connector or electrical connector assembly that has a housing, a contact carrier, one or more spring members, and an interposer. The contact carrier is movable with respect to the housing between unmated and mated electrical positions.

22 Claims, 7 Drawing Sheets

(56) References Cited

U.S. PATENT DOCUMENTS

| | | | |
|---|---|---|---|
| 7,946,892 | B2 | 5/2011 | Carboni et al. |
| 8,057,241 | B2 | 11/2011 | Tamura |
| 8,506,314 | B2 | 8/2013 | Gramsamer |
| 9,563,024 | B2 | 2/2017 | Zhong et al. |
| 9,570,829 | B2 | 2/2017 | Wimmer |
| 2014/0270645 | A1 | 9/2014 | Toth |

* cited by examiner

SPRING LOADED ELECTRICAL CONNECTOR

RELATED APPLICATIONS

This application is a continuation-in-part of U.S. application Ser. No. 16/054,746, entitled Spring Loaded Electrical Connector, filed on Aug. 3, 2018, which is a continuation of U.S. application Ser. No. 15/615,470, entitled Spring Loaded Electrical Connector, filed on Jun. 6, 2017, now U.S. Pat. No. 10,050,367, the subject of each of which is incorporated by reference.

FIELD OF THE INVENTION

The present invention relates to an electrical connector that has a spring loaded core or contact carrier designed to ensure optimum mating force with a mating connector for consistent signal integrity.

BACKGROUND OF THE INVENTION

Conventional high density electrical connectors often have contact intermittency and mating reliability issues on the mating interface due to the tight pitch and density necessary to achieve a small package size which results in tolerance stack-up related connectivity failures. In addition, conventional high density connectors are costly to manufacture and bulky due to increased signal count. Therefore, a need exists for an electrical connector that provides a high density of contacts without increasing the size of the connector and where when mated with another connector of a connector system, provides stability and consistent signal integrity to the connector system.

SUMMARY OF THE INVENTION

Accordingly, the present invention may provide an electrical connector that comprises a housing that has a mating interface end section, an opposite cable termination end section, and an inner support member. A core is slidably coupled to the inner support member of the housing and includes a receiving end and a spring engagement end. A spring member is received inside of the housing and behind the core for abutment with the spring engagement end of the core. An interposer may be received in the receiving end of the core and remote from the spring member. The core is axially slidable with respect to the inner support member along a longitudinal axis of the housing between an unmated position, in which the spring member pushes the core outwardly away from the cable termination end of the housing, and a mated position, in which the core pushes inwardly against the spring member.

In a preferred embodiment, the electrical connector includes a contact member coupled to the core where the contact member has one end adjacent to the interposer and another end near or at the cable termination end section of the housing. The contact member may be a flexible printed circuit board that has an end face and an opposite tail end. The interposer may include at least one contact side for electrically connecting with the contact member. The interposer may be supported in the receiving end of the core by the inner support member of the housing.

In other embodiments, the at least one contact side includes a plurality of individual contacts that electrical connect with the contact member coupled to the core; the interposer includes a second contact side that is opposite to at least one contact side for electrically connecting with a mating connector; and one or more alignment pins may be provided that extend through the interposer and into the core to align the interposer with the contact member. These alignment pins may be fine alignment features that also extend through to the mating connector to ensure fine enough alignment between the connectors so that all contacts line up with the mating pad of the flex circuits. In another embodiment, the inner support member of the housing is a longitudinally extending center post and the center post has a distal free end that extends beyond the mating interface end section of the housing and through the interposer. In one embodiment, the spring member is one or more wave springs.

The present invention may also include an electrical connector that comprises a housing having a mating interface end section, an opposite cable termination end section, and an inner support member, a core is slidably coupled to the inner support member of the housing and includes a receiving end and a spring engagement end. A spring member is received inside of the housing and behind the core for abutment with the spring engagement end of the core. A first contact member is coupled to the core. A double-sided contact interposer may be received in the receiving end of the core and remote from the spring member and includes opposite first and second contact sides, the first contact side is configured to electrically connect with the first contact member and the second contact side is configured to electrically connect with a mating connector. The core is axially slidable with respect to the inner support member along a longitudinal axis of the housing between an unmated position, in which the spring member pushes the core outwardly away from the cable termination end of the housing, and a mated position, in which the core pushes inwardly against the spring member.

In one embodiment, the first contact member coupled to the core is a flexible printed circuit board that has an end face in contact with the first contact side of the double-sided contact interposer and a tail end located at or near the cable termination end section of the housing. In another embodiment, the contact member may be a conventional rigid printed circuit board. The first and second contact sides of the double-sided contact interposer may include a plurality of individual contacts. In another embodiment, the double-sided contact interposer has a wafer body supporting the plurality of individual contacts and each individual contact is a C-clip. The inner support member of the housing may be a longitudinally extending center post that has a distal free end that extends beyond the mating interface end section of the housing and through the double-sided contact interposer.

In a preferred embodiment, a mating connector is coupled to the housing when the core is in the mated position such that a second contact member of the mating connector is received in the core and electrically connects with the second side of the double-sided contact interposer and the first contact member electrically connects to the first side of the double-sided contact interposer. The second contact member may be a flexible printed circuit board having an end face that abuts the second contact side of the double-sided contact interposer. In yet another embodiment, an outer coupling member is received on the mating interface end section of the housing for coupling the mating connector to the housing. In other embodiments, the inner support member of the housing is a longitudinally extending center post where the post has a distal free end that extends beyond the mating interface end section of the housing, through the double-sided contact interposer and engages with a corresponding post of the mating connector; one or more alignment pins may extend through the first contact member, the double-sided contact interposer, and the second contact member for alignment thereof; and the spring member is one or more wave springs. In another embodiment, keyways may be provided on the connector and the mating connector which act as gross alignment features for proper alignment of the connectors.

The present invention may yet provide an electrical connector that comprises a housing that has a mating interface end section and an opposite cable termination end section and the housing has an inner support member, a contact carrier is slidably coupled to the housing, the contact carrier includes a receiving end and a spring engagement end, and the contact carrier supports at least one contact member, at least one spring member received inside of the housing and adjacent the contact carrier for abutment with the spring engagement end of the contact carrier, and an interposer is received in the receiving end of the contact carrier and remote from the spring member. The contact carrier is slidable with respect to the housing along a mating axis between unmated and mated positions.

In certain embodiments, the interposer includes at least one contact side for electrically connecting with the contact member; the at least one contact side includes a plurality of individual contacts that electrical connect with the contact member coupled to the contact carrier; and/or the interposer includes a second contact side that is opposite to the at least one contact side for electrically connecting with a mating connector. In other embodiments, one or more alignment pins that extend through the interposer and into the contact carrier to align the interposer with the contact member and/or a coupling member associated with the housing for coupling the mating connector to the housing.

The present invention may yet still provide an electrical connector that comprises a housing that has a mating interface end section and an opposite cable termination end section, a contact carrier slidably coupled to the housing, the contact carrier that includes a receiving end and a spring engagement end, and the contact carrier supports at least one contact member, at least one spring member is received inside of the housing and adjacent the contact carrier for abutment with the spring engagement end of the contact carrier, an interposer is received in the receiving end of the contact carrier and remote from the spring member, and a coupling member is associated with the housing. The contact carrier is slidable with respect to the housing along a mating axis between unmated and mated positions.

In some embodiments, the contact member is a flexible printed circuit board; the interposer has a wafer body supporting a plurality of individual contacts and each individual contact is a C-clip; and/or one or more alignment pins extending through the first contact member, the interposer, and the second contact member for alignment thereof.

The present invention may also provide an electrical connector that comprises a housing that has receiving area and a mating interface and a contact carrier received in the housing. The contact carrier may include a receiving portion and a spring engagement portion, and supports a contact member. An interposer is mounted on the receiving portion of the contact carrier with the contact member therebetween. One or more spring members are provided which are operatively associated with the spring engagement portion of the contact carrier. The contact carrier is movable with respect to the housing between unmated and mated electrical positions along an axis that is perpendicular or substantially perpendicular to a longitudinal mating axis.

In certain embodiments, the contact member is a flexible circuit board; the interposer includes at least one contact side for electrically connecting with the contact member; the at least one contact side includes a plurality of individual contacts that electrical connect with the contact member coupled to the contact carrier; and/or the interposer includes a second contact side that is opposite to the at least one contact side for electrically connecting with a mating connector. In an embodiment, the electrical connector may further comprise one or more alignment pins that extend through the contact carrier and into or through the interposer to align the interposer with a contact member of a mating connector.

The present invention may further provide an electrical connector assembly that comprises a receptacle that comprises a housing that has a receiving area, a contact carrier received in the housing wherein the contact carrier includes a receiving portion and a spring engagement portion, and the contact carrier supporting a first contact member, an interposer mounted on the receiving portion of the contact carrier with the contact member therebetween, and one or more spring members operatively associated with the spring engagement portion of the contact carrier. The contact carrier is movable with respect to the housing between unmated and mated electrical positions. The assembly may also comprise a plug that comprises a housing that has a mating interface configured for insertion into the receiving area of the housing and has a second contact member configured to engage the interposer of the housing on a side opposite the first contact member.

In one embodiment, the contact carrier of the assembly moves between the unmated and mated electrical positions along an axis that is perpendicular or substantially perpendicular to a longitudinal mating axis of the receptacle and plug. In another embodiment, one or more alignment pins extend through the first contact member, the interposer, and the second contact member for alignment thereof.

In other embodiments, the assembly further comprises a latching mechanism for securing the contact carrier in the mated electrical position; the latching mechanism is a cam member configured to rotate between inactive and active positions to move the contact member of the plug which moves the contact carrier or contact system of the receptacle between the unmated and mated electrical positions, respectively; the cam member may be rotated a select or predetermined number of degrees, such as about 45, about 90, about 135, about 180, or about 225 degrees, for example, (or any other appropriate degree of angle) from the inactive position to the active position; the cam member includes a stem that has a width and a thickness, and the width is greater than the thickness; the cam member has an end coupled to a coupling nut of the plug; the latching mechanism is a slide latch member configured to slide between inactive and active positions to move the contact member of the plug which moves the contact carrier or contact system of the receptacle between the unmated and mated electrical positions, respectively; and/or the plug includes an elevator support associated with the second contact member, the elevator support is configured to move between first and second positions in concert with the inactive and active positions, respectively, of the slide latch member; and/or the latching mechanism includes a latch activation release at the mating interface of the plug configured to depress when the plug is mated with the receptacle.

In another embodiment, the latching mechanism may comprise a latch activation release system that will only allow the activation of the latching/mating mechanism if this system is engaged within the mating receptacle (i.e. fully mated). This latch activation release system may comprise a spring probe system at the nose of the plug that depresses when mated with the receptacle and subsequently allows the engagement of the coupling mechanism and thus latching activation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Figure 1:
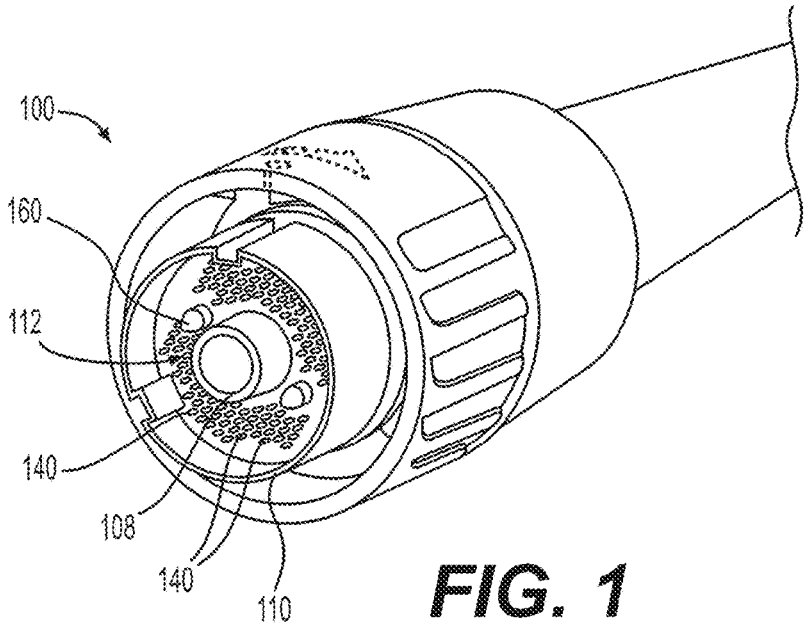
FIG. 1 is a front perspective view of an electrical connector according to an exemplary embodiment of the present invention.
Figure 2:
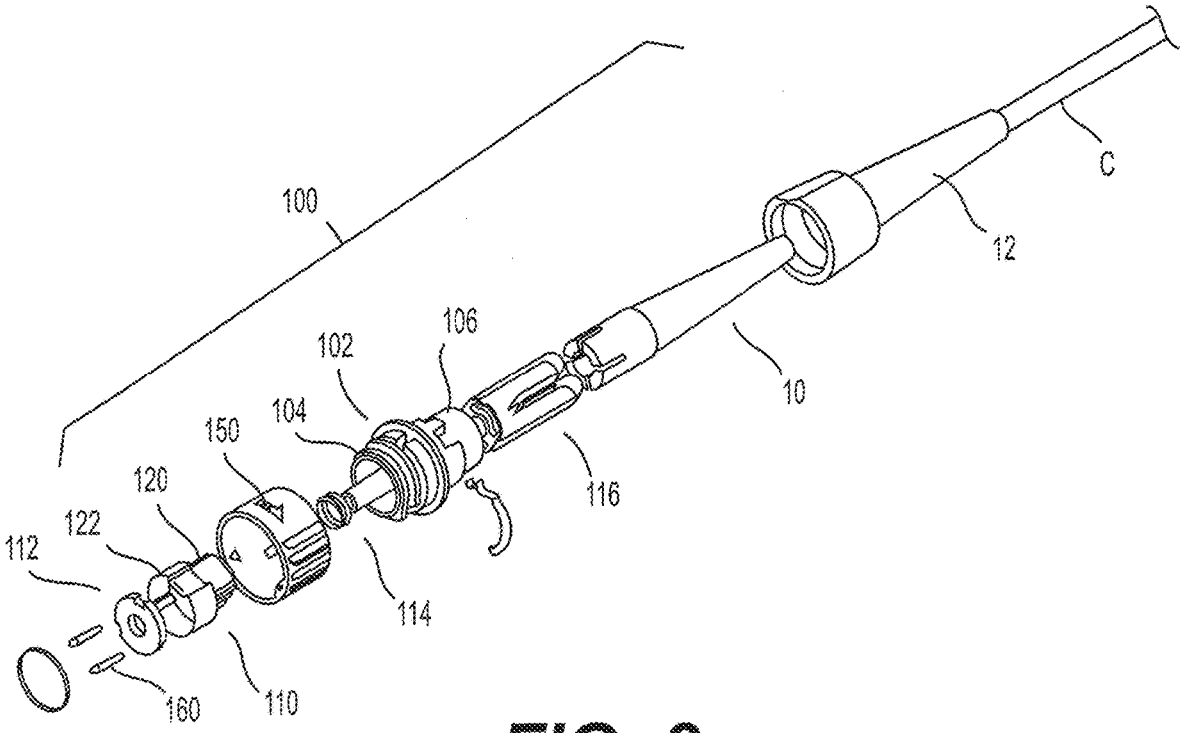
FIG. 2 is an exploded perspective view of the electrical connector illustrated in FIG. 1.

Referring to FIGS. 1-4, 5A, 5B, and 6, the present invention generally relates to an electrical connector 100, preferably a high density electrical connector, that incorporates a spring loaded core or contact carrier 110 designed to provide positive electrical contact with a mating connector 200, thereby ensuring consistent signal integrity across the connector system, that is without intermittencies before or during use of the system. Spring loaded core or contact carrier 110 is designed to allow over-travel to overcome the tolerance stack of the mated connector to ensure each of the contacts are fully engaged. Additionally, spring loaded core or contact carrier 110 maintains the electrical connection between the connectors even if their respective mating faces are non-planar to each other during mating. In a preferred embodiment, the spring loaded core or contact carrier 110 of the electrical connector 100 cooperates with a double-sided contact interposer 112 to provide the consistent electrical connection between connectors 100 and 200. Another advantage of the connector of the present invention is that it may have an increased density, such as 1 mm, pitch, and may be mated/unmated, up to 5,000 times. Additionally, the connector of the present invention provides an increased high density of signal contacts at low cost and that is reliable for up to 5K cycles. The design of the connector of the present invention allows users to increase the signal count while keeping the same size connector and raw cable.

In general, electrical connector 100 includes a housing 102 that slidably supports core or contact carrier 110, a spring member 114 received in housing 102 behind core 110, the interposer 112 which is received in core 110, and a contact member 116. Core or contact carrier 110 slides axially along a longitudinal axis of housing 102 between an unmated position (FIG. 3), in which core 110 is biased outwardly ready to be mated with mating connector 200, and a mated position (FIG. 4), in which core 110 is pushed inwardly and compresses spring 114 and electrically engages the mating connector. Spring member 114 may be any biasing member, such as one or more wave springs or the like.

Figure 3:
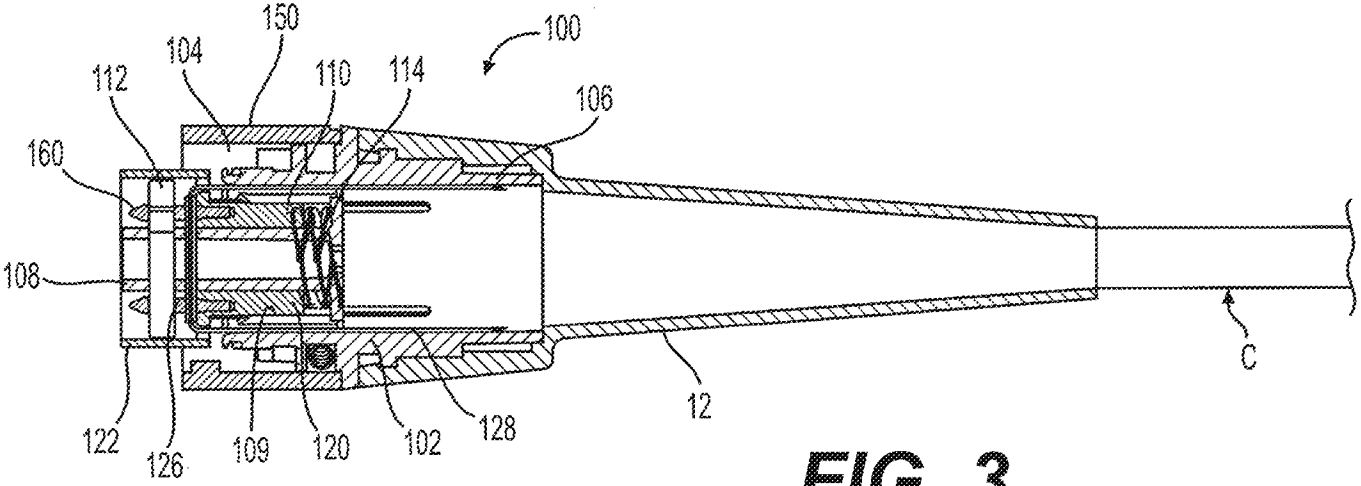
FIG. 3 is a cross-sectional view of the electrical connector illustrated in FIG. 1, showing a core or contact carrier of the electrical connector in an unmated position.
Figure 4:
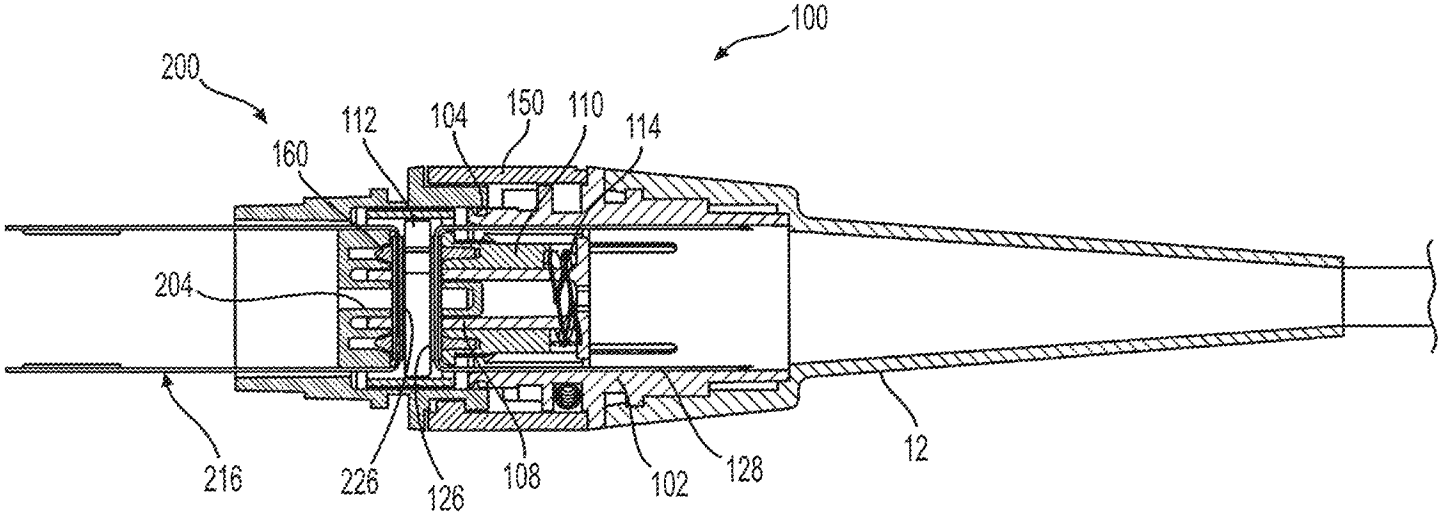
FIG. 4 is a cross-sectional of the electrical connector illustrated in FIG. 1, showing the electrical connector mated to a mating connector and showing the core or contact carrier thereof in a mated position.

Housing 102 generally includes a mating interface end section 104 for interfacing with a mating end 202 of mating connector 200, a cable termination end section 106 that receives a prepared end of a cable C, an inner support member 108 that slidably supports core 110, and an inner receiving area 109 surrounding inner support member 108 for receiving at least a portion of core 110 and receiving spring member 114 inside of housing 102. Cable termination end section 106 may also receive a potting member 10 and a strain relief member 12, such as a boot, for the prepared end of the cable C, as is well known in the art. Inner support member 108 is preferably a longitudinally extending center post or barrel, as seen in FIGS. 3 and 4. The post 108 may extend outwardly beyond mating interface end section 104 such that a distal free end thereof may engage a corresponding component 204 of mating connector 200 to provide stability to the connector system when the connectors 100 and 102 are mated, as best seen in FIG. 4. In one embodiment, post 108 is hollow at its distal end to receive corresponding component 204 of mating connector 200, which may be a post sized to be insertable into the distal end of post 108.

Core or contact carrier 110 is mounted on and slides along inner post 108 of housing 102 between its unmated and mated positions. Core 110 may also be slidably attached to the housing 102, such as by snaps and the like. Core 110 generally includes a spring engagement end 120 that abutments spring member 114 when core 110 is compressed inwardly in the mated position, and a receiving end 122 that sized and shaped to accept interposer 112. Contact member 116 is mounted in the core's spring engagement end 102 preferably such that one end is adjacent interposer 112 and its other end is near or at cable termination end section 106 of housing 102. Contact member 116 may be, for example, a flexible printed circuit board that has an end face 126 received in core 110 that is configured to electrically engage interposer 112 and a tail end 128 that connects to cable C. The tail end 128 of the flexible printed circuit board is designed to allow for bucking due to the spring loaded movement of core 110 along inner post 108 between its unmated and mated positions.

Figure 6:
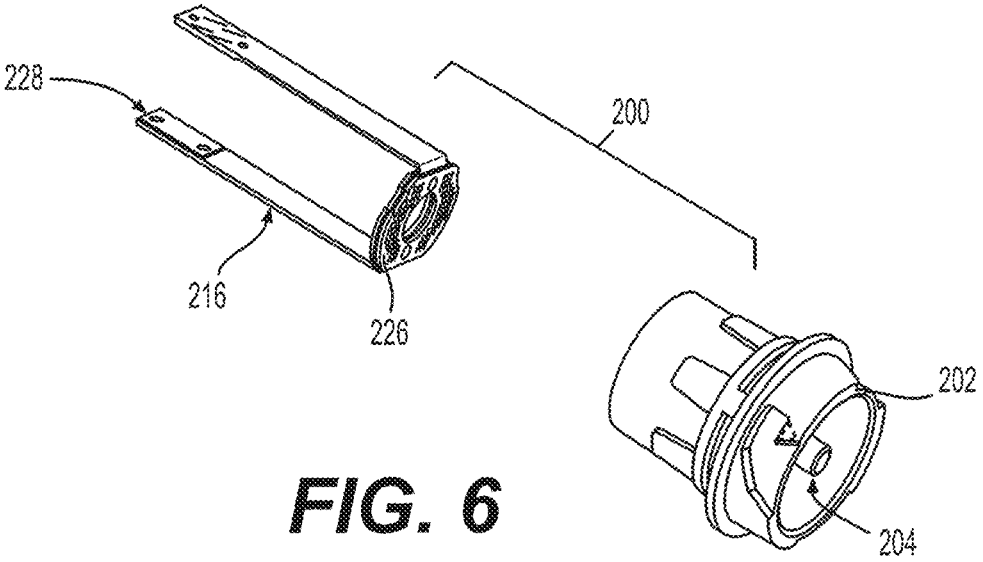
FIG. 6 is an exploded view of a mating connector that mates with the electrical connector illustrated in FIG. 1.
Figure 7A:
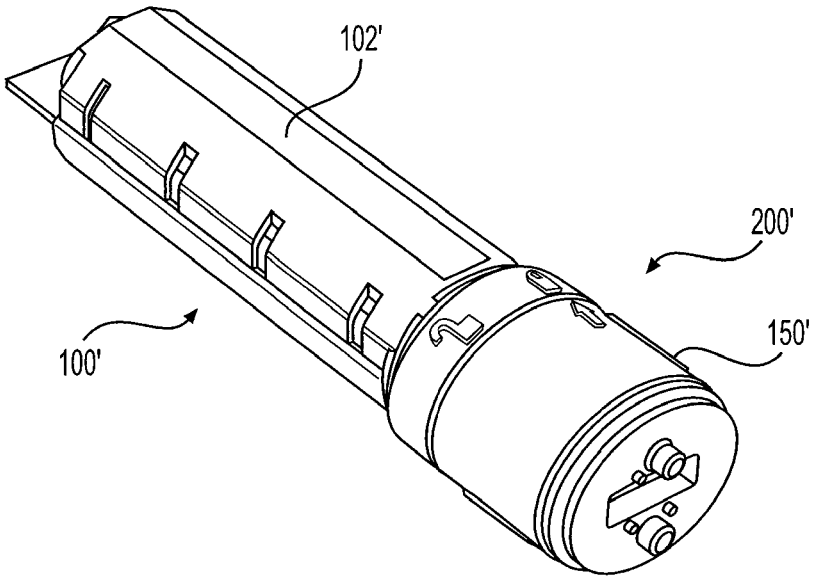
FIGS. 7A and 7B is a perspective and exploded views of a mated pair of electrical connectors in accordance with an alternative exemplary embodiment of the present invention, showing the electrical connectors assembled.
Figure 7B:
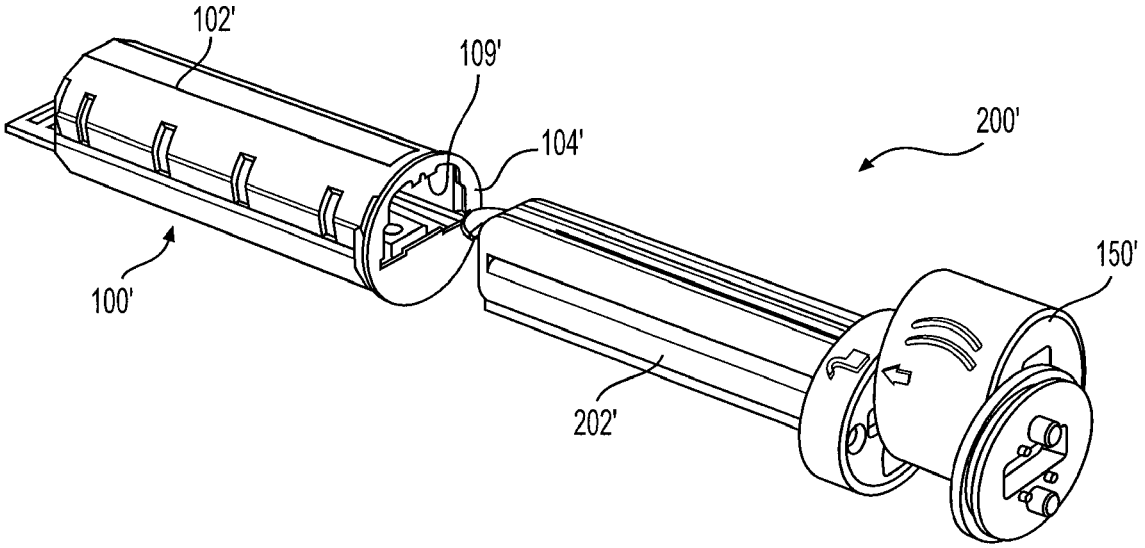

Interposer 112 includes at least one contact side 130 for electrically contacting contact member 116, preferably at the end face 126 thereof. In a preferred embodiment, interposer 112 is a double-sided contact interposer that has a second contact side 132 that is opposite the contact side 130 and configured to electrically contact a contact member 216 of mating connector 200. Contact member 216 of mating connector 200 may also be a flexible printed circuit board with an end face 226 and tail end 228, as seen in FIG. 6, similar to contact member 116. The end face 226 is configured to abut the second contact side 132 of interposer 112.

Figure 5A:
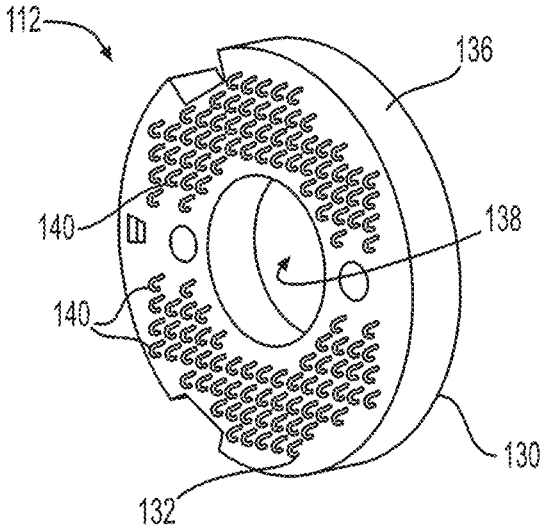
FIG. 5A is a perspective view of one side of an interposer of the electrical connector illustrated in FIG. 1.
Figure 5B:
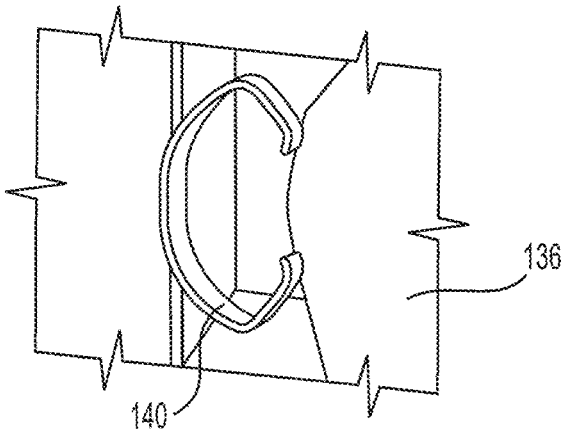
FIG. 5B is an enlarged view of an individual contact of the interposer illustrated in FIG. 5A.

In one embodiment, interposer 112 has a wafer body 136 that may include a central opening 138 sized to receive the post 108 of housing 102. Each of the contacts sides 130 and 132 of interposer 112 may include a plurality of individual contacts 140, as seen in FIG. 5A, for electrical contact with contact members 116 and 216, respectively. The individual contacts 140 may be, for example, conductive C-clips, as seen in FIG. 5B, or the like. The biasing force of spring member 114 is preferably higher than the mating force of each individual C-clip 140 loaded on interposer 112 to provide overtravel of core or contact carrier 110 beyond the full mating compression of C-clips for consistent contact with spring member 114. This ensures full compression of the contact member's end face 126 on the individual contacts 140 so that the connector system, that is the mated connectors, will have consistent mating force because that force will be dictated by the spring member 114. The mating force of the connector system may be adjusted for use of different spring members. For example, the number of individual contacts 140 of interposer 112 may be increased or decreased to increase or decrease, respectively, their biasing force where the biasing force of spring member 114 can compensate for this increase or decrease in the contacts' 140 biasing force to provide the overtravel of core or contact carrier 110. As such, the connector system can be structured to have the minimum max insertion force that can be achieved with respect to a given number of contacts.

Once the connectors 100 and 200 are mated, a coupling member 150, such as a coupling nut, may be employed to latch the connectors together. Coupling nut 150 may be designed, for example, to be spring loaded so that it autorotates and latches in place. Although the coupling nut 150 is preferably used to latch connectors 100 and 200, any know latching mechanism and/or friction fit may be used to latch or secure the connectors 100 and 200 together.

In one embodiment, the center post 108 and its corresponding component 204 of mating connector 200 generally provide the gross-alignment of the connector system, while one or more alignment members 160, such as alignment pins, generally provide fine alignment of the connector system. The one or more alignment pins 160 may extend through contact end face 226, interposer 112, contact end face 126, and into core 110 to align interposer 112, and particularly its individual contacts 140, with the end faces 126 and 226, respectively, of contact members 116 and 216 of each of the connectors 100 and 200. Alignment pins 160 may also extend through to the mating connector to ensure fine enough alignment between the connectors so that all contacts line up with the mating pad of the flex circuits.

FIGS. 7A-11 illustrate an alternative exemplary embodiment of the present invention, connector 100'. Connector 100' also has the back-spring over travel design, as described in the embodiment above. And the connector 100' and its mating connector 200' each have interconnect features, similar to those described above, except they engage one another in a direction generally perpendicular to the mating or longitudinal axis of the connector assembly. The design of connector 100' advantageously provides a reduced outer diameter of the connector while allowing for an extended length of the connector for a higher density contact count. This may be particularly beneficial for hand held applications in which a smaller outer diameter is preferred for a user to handle and operate the connector (i.e. generally fits in the user's hand), such as a catheter handle or the like.

Figure 8:
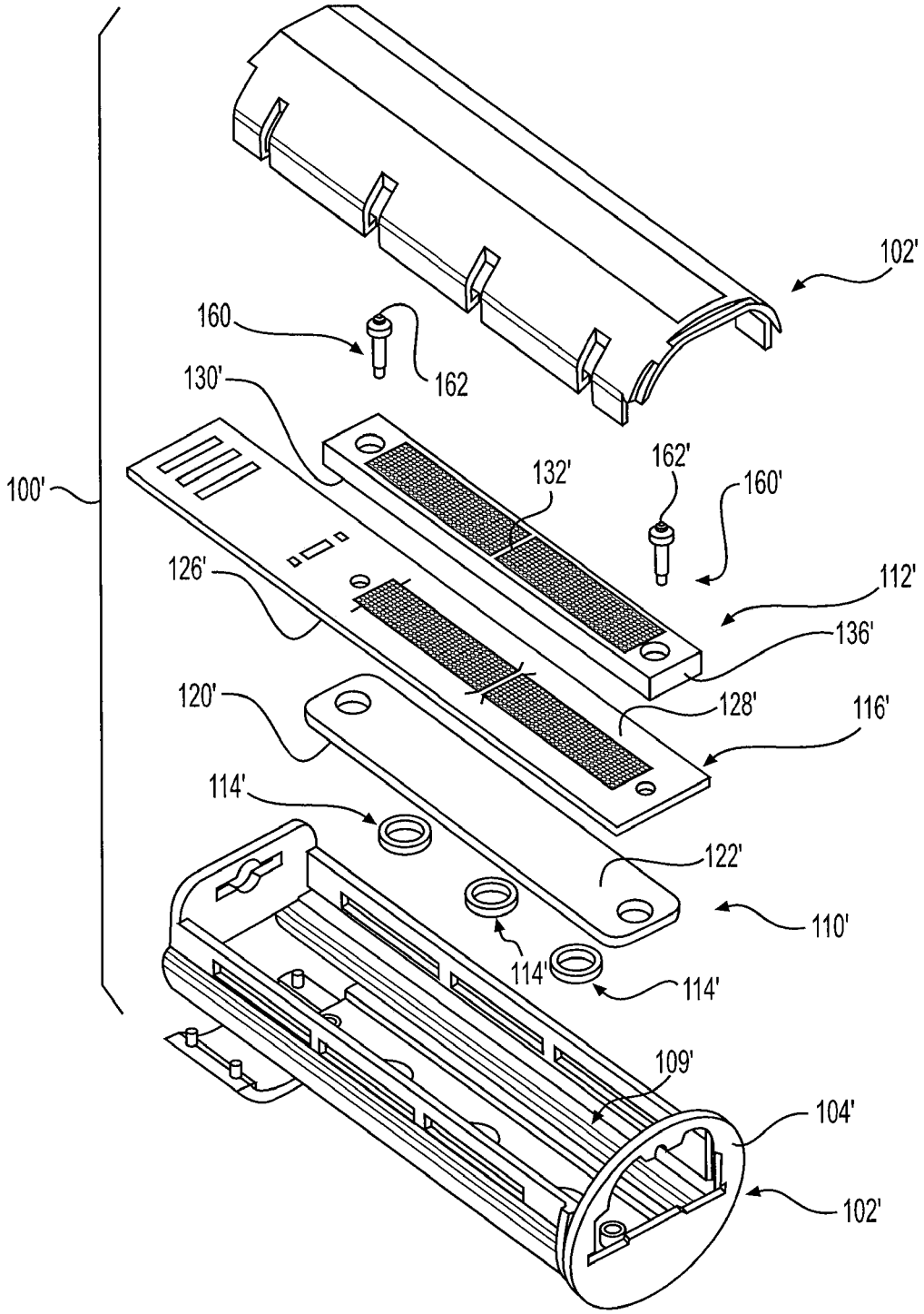
FIG. 8 is an exploded view of one of the electrical connectors illustrated in FIGS. 7A and 7B.

Like with connector 100, connector 100' generally includes a housing 102' that movably supports core or contact carrier 110', spring member or members 114' received in housing 102' in association with contact carrier 110', an interposer 112', and a contact member 116 supported by contact carrier 110', as seen in FIG. 8. Connector 100' is designed such that contact carrier 110' moves in housing 102' in a direction perpendicular or substantially perpendicular to the longitudinal mating axis L of the connector assembly acting as an over-travel relief, between an unmated position (FIG. 10A), in which contact carrier 110' is biased toward and ready to be electrically mated with mating connector 200', and a mated position (FIG. 10B), in which contact carrier 110' is compressed against spring members 114' and electrically engages a contact member 216' of mating connector 200'. Spring members 114' may be any biasing member, such as one or more wave springs, compression springs, elastic materials, or the like.

Figure 10A:
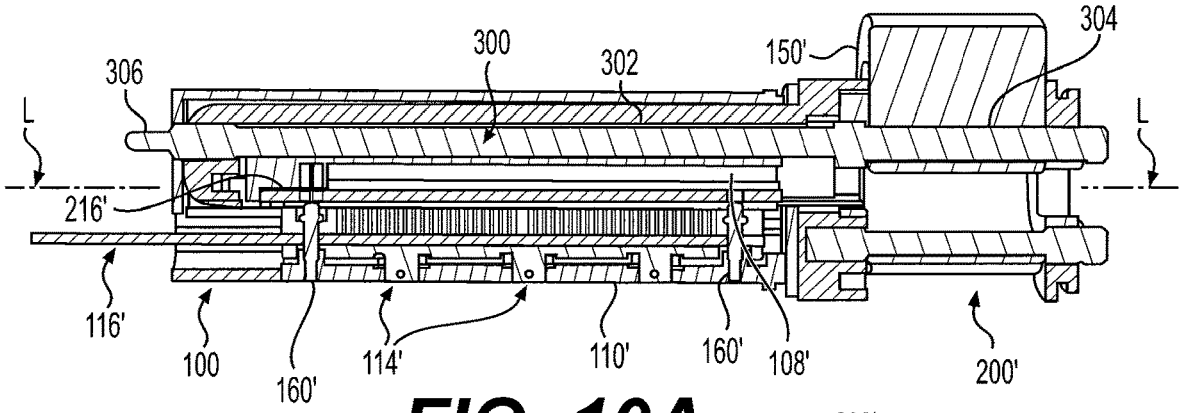
FIGS. 10A and 10B are cross-sectional views of the assembly of the electrical connectors of FIG. 7A, showing the unmated and mated electrical positions, respectively.
Figure 10B:
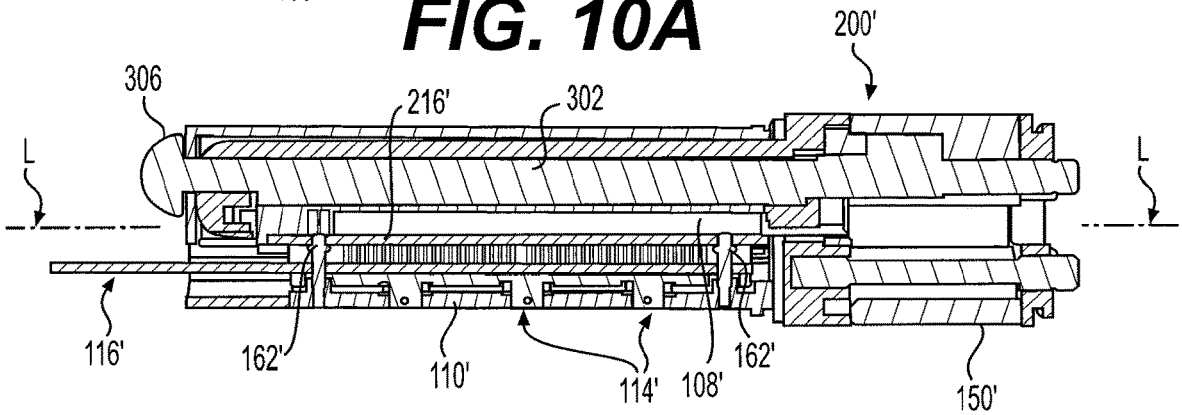
Figure 11:
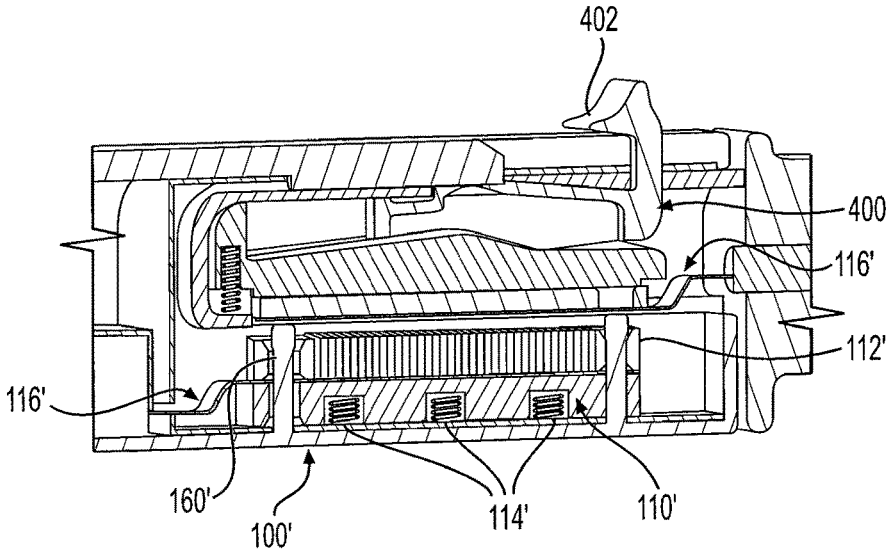
FIG. 11 is a cross-sectional view of the assembly of an electrical connector assembly according yet another exemplary embodiment of the present invention.

Housing 102' generally includes a mating interface end section 104' for interfacing with a mating end 202' of mating connector 200', and an inner receiving area 109' for receiving contact carrier 110', interposer 112', and spring members 114' inside of housing 102'. Contact carrier 110' is mounted in housing 102' and is movable between unmated and mated electrical positions, as seen in FIGS. 10A and 10B. Contact carrier 110' generally includes a spring engagement portion 120' that couples with spring members 114' when contact carrier 110' is compressed in the mated position by the mating connector 200', and a receiving portion 122' that supports the contact member 116' and the interposer 112'. Contact member 116' may be, for example, a flexible printed circuit board that has one face 126' that mounts on the receiving portion 122' of contact carrier 110' and opposite face 128' configured to electrically engage interposer 112'.

Interposer 112' is similar to interposer 112 described in the embodiment above as it includes a first contact side 130' for electrically contacting contact member 116', preferably at the face 126' thereof, and a second contact side 132' that is opposite the first contact side 130' and configured to electrically connect with contact member 216' of mating connector 200'. Like interposer 112, the interposer 112' of this embodiment may have a wafer body 136' and each of its contacts sides 130' and 132' may include a plurality of individual contacts, such as conductive C-clips or the like. The biasing force of spring members 114' is preferably higher than the mating force of each individual contact loaded on interposer 112' to provide overtravel of contact carrier 110' beyond the full mating compression of the individual contacts for consistent contact with contact member 216'. This ensures full compression of the contact members on the individual contacts of interposer 112' so that the connector system or assembly, that is the mated connectors, have a consistent mating force.

Figure 9A:
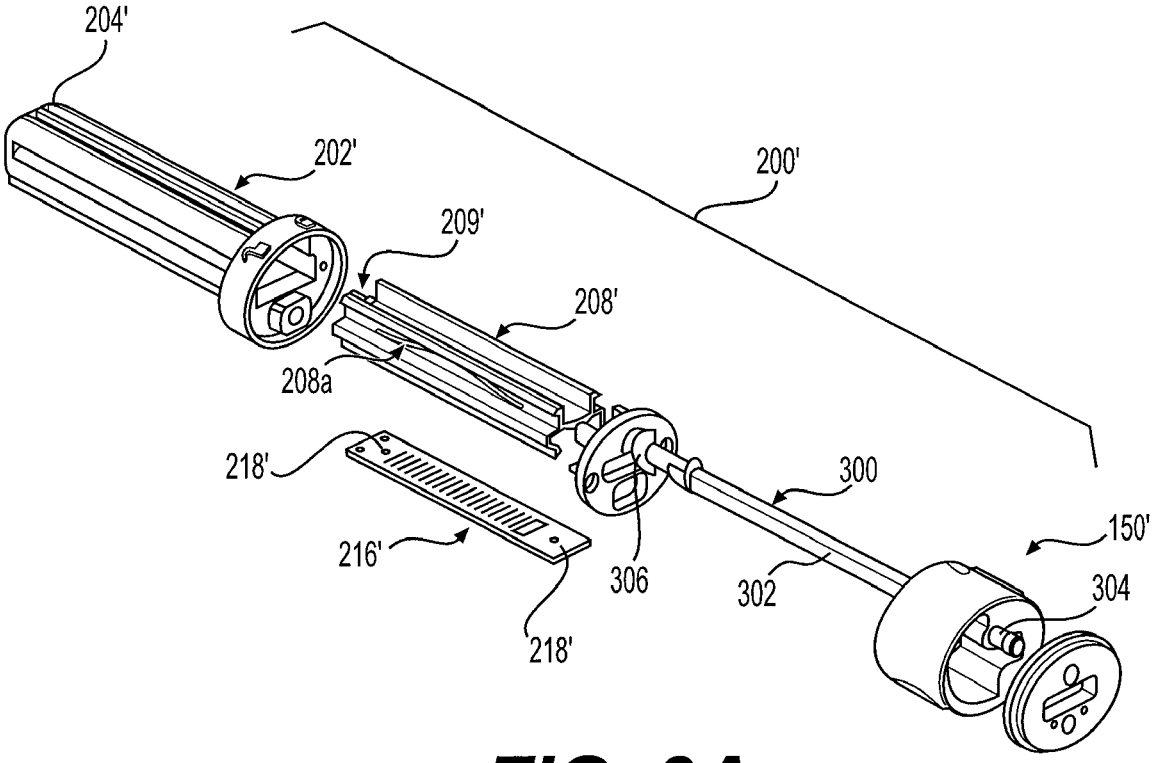
FIGS. 9A and 9B are exploded and perspective views of the other of the electrical connectors illustrated in FIGS. 7A and 7B.
Figure 9B:
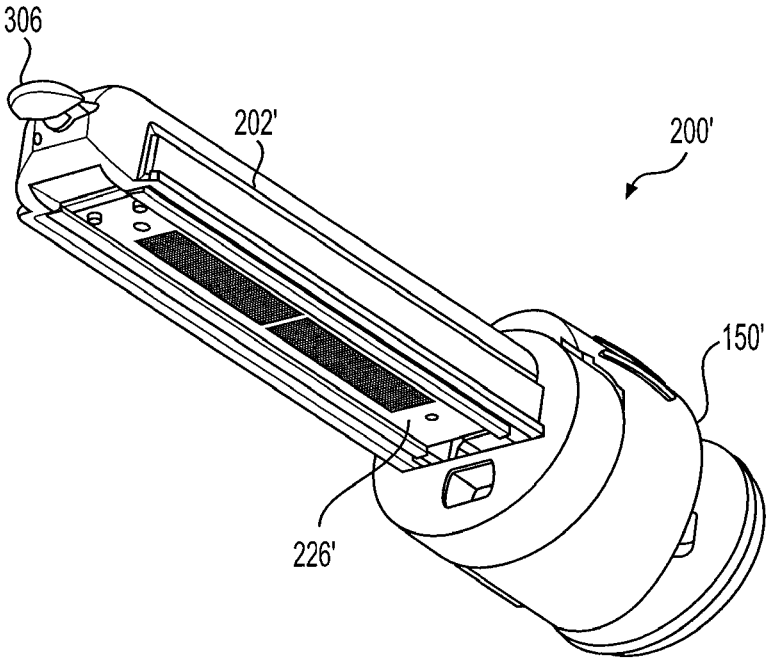

As seen in FIGS. 9A and 9B, mating connector 200' may have a housing 202' with an interface end 204' and a coupling nut 150' opposite thereof. The housing 202' includes an inner elevator support 208' that contains the second contact member 216'. Elevator support 208' moves between a first position (FIG. 10A) and a second position (FIG. 10B) in concert with the unmated and mated electrical positions, respectively, of the contact carrier 110'. The elevator support 208' may be spring loaded in the unmated position by an elevator biasing spring 208*a*', for example, to prevent "crashing" during the gross alignment axial engagement with the mating connector 100' prior to electrical connection. Contact member 216' of mating connector 200' may also be a flexible printed circuit board with a contact face 226' similar to contact member 116'.

The connector 100' may be, for example, a receptacle and the mating connector 200' may be, for example, a plug, that inserts into the receptacle. Once the connectors 100' and 200' are axially assembled, that is the interface end 204' of plug 200' is received in housing 102' of receptacle 100', a latching mechanism may be activated to complete and secure the electrical connection between the receptacle and plug. The latching mechanism is designed to move the plug's contact member 216' toward the interposer 112' of the receptacle in a direction substantially perpendicular to the axis of plug to receptacle mating.

In one embodiment, the latching mechanism may comprise a cam member 300 supported by the plug and that is rotatable between inactive and active positions. Cam member 300 may comprise an elongated stem 302 having one end 304 connected to the plug's coupling nut 150' and an opposite lock end 306. The elongated stem 302 may be generally flat, that is it may be wider than it is thick, such that when the cam member 300 is rotated the predetermined number of degrees, e.g. 90 or about 90 degrees, from its inactive position (FIG. 10A) to its active position (FIG. 10B), the stem 302 forces the elevator support 208' of the plug, which supports the plug's contact member 216', from its first position toward the receptacle's interposer 112' (downward in FIGS. 10A and 10B) to its second position. That is, when the coupling nut 150' is turned, the cam member 300 activates to move the contact member 216', via the elevator support 208', from its unmated electrical position towards the mating receptacle contact system to its mated electrical position, thereby electrically connecting the plug and the receptacle. In that position, the lock end 306 locks or abuts against the plug's housing 202'.

The latching mechanism may alternatively be a slide latch member 400, as seen in FIG. 9. The slide latch member 400 is configured to slide between inactive and active positions. That is, when the slide latch member is moved from its inactive position and slid to its active position, the elevator support 208' of the plug is forced from its first position toward the receptacle's interposer 112' to its second position, thereby moving the contact carrier 110' from its unmated electrical position to its mated electrical position to electrically connect the plug's contact member 216' with the receptacle's interposer 112'. The slide latch member 400 may have a feature 402, such as a snapping feature, that prevents premature mating of the components prior to plug/receptacle assembly. In this embodiment, the receptacle 100' may push the feature 402 out of interference within the plug 200', thereby allowing the slide latch member 400 to be engaged.

In yet another embodiment, the latching of the plug into the receptacle when fully seated may be provided such as, a friction fit, spring clip latch, or locking latching mechanism. The latching mechanism may incorporate a latch activation release system configured to prevent the contact system coupling nut from being activated without engagement of the plug and receptacle. This would ensure that the plug and receptacle will seat without damage to the plug contact system. A spring loaded mechanism, such as a spring probe, may be included in the interface end 204' of the plug which prevents the cam member 300 from being activated/turned by the user because of interference with the interface end 204' of the cam member (which also acts as a locking feature to the receptacle when engaged and activated). Once the plug's interface end 204' is fully bottomed into the receptacle, the spring loaded mechanism may be depressed out of the way from the cam member 300, thereby allowing the user to rotate the coupling nut 150', which engages the plug contact system to the receptacle contact system and, additionally, latches the plug to the receptacle so that it cannot be disengaged unless decoupled by the user manually by rotating the coupling nut 150' back to the unactivated state to mating.

In an embodiment, the coupling nut 150' may be spring loaded in a locked state. The coupling nut 150' may have mating orientation features, such as extruded bosses, which engage corresponding receptacle mating features, such as extruded bosses, which rotate the coupling nut 150' into an unlocked state during mating. As the receptacle and plug are being assembled together, the coupling nut 150' orientation features overcome the receptacle orientation features and latch into place. As such, the latching, via the latching mechanism, and the electrical engagement between the components is simultaneous or near simultaneous.

In another embodiment, the coupling nut 150' utilizes mating orientation features that correspond to mating orientation features on the receptacle, similar to the above; however the latching and electrical engagement is not simultaneous. After initial assembly of the receptacle and plug, the coupling nut 150' may be rotated towards a lock direction which cams the plug's contact system, i.e. elevator support 208' and contact member 216', into the mating receptacle contact system, i.e. interposer 112', thereby fully engaging the electrical engagement and overtravel springs 114'. This allows the user to overcome high axial mating forces by utilizing the latching mechanism, such as cam member 300, for a mechanical advantage.

One or more alignment pins 160' may be provided in the receptacle's housing 102' to facilitate alignment with the plug's connector system when the latching mechanism, such as cam member 300, is actuated to complete electrical coupling of the receptacle and plug. The pins 160' may extend through contact carrier 110', contact member 116', and into interposer 112', leaving the ends 162' thereof ready for engagement with the plug's contact member 216', as seen in FIG. 10A. The plug's contact member 216' may include holes 218' that correspond to the receptacle's alignment pins 160' such that when the latching mechanism is actuated, the plug's holes 218' receive the ends 162' of the alignment pins 160', for proper fine alignment and contact line up of the receptacle's interposer 112' with the plug's contact member 216'. Alternatively, the alignment pins may be provided in the plug 200' which engage corresponding holes in the receptacle 100'.

While particular embodiments have been chosen to illustrate the invention, it will be understood by those skilled in the art that various changes and modifications can be made therein without departing from the scope of the invention as defined in the appended claims. A method to prevent the contact system coupling mechanism from being activated without engagement of the plug and receptacle may be incorporated. This would ensure that the plug and receptacle will be able to seat without damage to the contact system or interposer. A spring loaded mechanism, such as the embodied spring probe 209', may be included in the interface end 204' of the plug which prevents the cam member 300 from being activated/turned by the user because of interference with the interface end 204' of the cam member (which also acts as a locking feature to the receptacle when engaged and activated). Once the plug's interface end 204' is fully bottomed into the receptacle, the spring loaded mechanism may be depressed out of the way from the earn member 300 by a mating feature in the receptacle, thereby allowing the user to rotate the coupling nut 150', which engages the plug contact system to the receptacle contact system and, additionally, latches the plug to the receptacle so that it cannot be disengaged unless decoupled by the user manually by rotating the coupling nut 150' back to the unactivated state.

What is claimed is:

1. An electrical connector, comprising:

a housing having receiving area and a mating interface;

a contact carrier received in the housing, the contact carrier including a receiving portion and a spring engagement portion, and the contact carrier supporting a contact member;

an interposer mounted on the receiving portion of the contact carrier with the contact member therebetween; and one or more spring members operatively associated with the spring engagement portion of the contact carrier, wherein the contact carrier is movable with respect to the housing between unmated and mated electrical positions along an axis that is perpendicular or substantially perpendicular to a longitudinal mating axis.

2. The electrical connector of claim 1, wherein the contact member is a flexible circuit board.

3. The electrical connector of claim 2, wherein the interposer includes at least one contact side for electrically connecting with the contact member.

4. The electrical connector of claim 3, wherein the at least one contact side includes a plurality of individual contacts that electrical connect with the contact member coupled to the contact carrier.

5. The electrical connector of claim 3, wherein the interposer includes a second contact side that is opposite to the at least one contact side for electrically connecting with a mating connector.

6. The electrical connector of claim 1, further comprising one or more alignment pins that extend through the contact carrier and into the interposer to align the interposer with a contact member of a mating connector.

7. An electrical connector assembly, comprising:

a receptacle comprising, a housing having a receiving area, a contact carrier received in the housing, the contact carrier including a receiving portion and a spring engagement portion, and the contact carrier supporting a first contact member, an interposer mounted on the receiving portion of the contact carrier with the first contact member therebetween, and one or more spring members operatively associated with the spring engagement portion of the contact carrier, wherein the contact carrier is movable with respect to the housing between unmated and mated electrical positions; and a plug comprising a housing having a mating interface configured for insertion into the receiving area of the receptacle housing and having a second contact member configured to engage the interposer of the receptacle housing on a side opposite the first contact member, such that the interposer is sandwiched between the first and second contact members when the plug is electrically mated to the receptacle.

8. The electrical connector assembly of claim 7, wherein each of the first and second contact members is a flexible printed circuit board.

9. The electrical connector assembly of claim 7, wherein the contact carrier moves between the unmated and mated electrical positions along an axis that is perpendicular or substantially perpendicular to a longitudinal mating axis of the receptacle and plug.

10. The electrical connector assembly of claim 7, further comprising a latching mechanism for securing the connector assembly in the mated electrical position.

11. The electrical connector assembly of claim 10, wherein the latching mechanism is a cam member configured to rotate between inactive and active positions to move the second contact member of the plug which moves the contact carrier of the receptacle between the unmated and mated electrical positions, respectively.

12. The electrical connector assembly of claim 11, wherein the cam member is rotated one of about 45, about 90, about 135, about 180, or about 225, from the inactive position to the active position.

13. The electrical connector assembly of claim 11, wherein the cam member includes a stem that has a width and a thickness, and the width is greater than the thickness.

14. The electrical connector assembly of claim 11, wherein the cam member has an end coupled to a coupling nut of the plug.

15. The electrical connector assembly of claim 11, wherein the plug includes an elevator support associated with the second contact member, the elevator support is configured to move between first and second positions in concert with the inactive and active positions, respectively, of the cam member.

16. The electrical connector of claim 10, wherein the latching mechanism is a slide latch member configured to slide between inactive and active positions to move the second contact member of the plug which moves the contact carrier of the receptacle between the unmated and mated electrical positions, respectively.

17. The electrical connector assembly of claim 16, wherein the plug includes an elevator support associated with the second contact member, the elevator support is configured to move between first and second positions in concert with the inactive and active positions, respectively, of the slide latch member.

18. The electrical connector assembly of claim 10, wherein the latching mechanism includes a latch activation release at the mating interface of the plug configured to depress when the plug is mated with the receptacle.

19. The electrical connector assembly of claim 7, wherein one or more alignment pins extend through the first contact member, the interposer, and the second contact member for alignment.

20. The electrical connector assembly of claim 7, wherein the interposer has opposite contact sides that include a plurality of C-clips contacts.

21. An electrical connector assembly, comprising:

a receptacle comprising, a housing having a receiving area, a contact carrier received in the housing, the contact carrier including a receiving portion and a spring engagement portion, and the contact carrier supporting a first contact member, an interposer mounted on the receiving portion of the contact carrier and the first contact member therebetween, and one or more spring members operatively associated with the spring engagement portion of the contact carrier, wherein the contact carrier is movable with respect to the housing between unmated and mated electrical positions; and a plug comprising a housing having a mating interface configured for insertion into the receiving area of the receptacle housing and having a second contact member configured to engage the interposer of the receptacle housing on a side opposite the first contact member, wherein each of the first and second contact members is a circuit board.

22. An electrical connector assembly, comprising:

a receptacle comprising, a housing having a receiving area, a contact carrier received in the housing, the contact carrier including a receiving portion and a spring engagement portion, and the contact carrier supporting a first contact member, an interposer mounted on the receiving portion of the contact carrier with the first contact member therebetween, and one or more spring members operatively associated with the spring engagement portion of the contact carrier, wherein the contact carrier is movable with respect to the housing between unmated and mated electrical positions; and a plug comprising a housing having a mating interface configured for insertion into the receiving area of the receptacle housing and having a second contact member configured to engage the interposer of the receptacle housing on a side opposite the first contact member, wherein each of the first and second contact members is a flexible printed circuit board.

* * * * *